US005526931A

United States Patent [19]

White

[11] Patent Number: 5,526,931

[45] Date of Patent: Jun. 18, 1996

[54] CARRIER FOR LONG, FLEXIBLE ELEMENTS SUCH AS CHRISTMAS LIGHTS

[76] Inventor: Dallas White, 3412-19 Cameo Dr., Oceanside, Calif. 92056

[21] Appl. No.: 321,753

[22] Filed: Oct. 12, 1994

[51] Int. Cl.[6] ..... B65D 85/42

[52] U.S. Cl. ..... 206/420; 206/419; 206/388; 206/702

[58] Field of Search ..... 206/419, 420, 206/421, 388, 49, 495, 702; 211/26; 242/127; 294/159, 170, 171

[56] References Cited

U.S. PATENT DOCUMENTS

| | | | |
|---|---|---|---|
| 897,173 | 8/1908 | Strassberger | 206/388 |
| 2,420,839 | 5/1947 | Ostrom | 242/127 |
| 2,984,347 | 5/1961 | Kalinchuk | 206/419 |
| 3,858,719 | 1/1975 | Isaacs | 206/49 |
| 4,971,200 | 11/1990 | Huang et al. | 206/420 |
| 5,152,396 | 10/1992 | Chen et al. | 206/420 |

*Primary Examiner*—David T. Fidei

[57] ABSTRACT

A carrier includes a base and handles on each end of that base with the handles being coaxial with the central axis of the base so that long, flexible elements, such as Christmas lights, that are to be stored on the carrier can be easily wound onto the carrier as well as unwound from that carrier. A plurality of arms are included and cavities are located near the central axis for releasably accommodating electric plugs associated with the flexible elements. One embodiment of the carrier has the handles fixed to a base, and a second embodiment has a swivel connection between the base and the handles. Hook-receiving holes are defined in the handles on the central axis whereby the carrier can be pendently supported for storage.

24 Claims, 4 Drawing Sheets

CARRIER FOR LONG, FLEXIBLE ELEMENTS SUCH AS CHRISTMAS LIGHTS

TECHNICAL FIELD OF THE INVENTION

The present invention relates to the general art of storing items, and to the particular field of storing long, flexible items, such as strings of Christmas lights.

BACKGROUND OF THE INVENTION

Many consumer items, such as Christmas lights, are sold in long, flexible strings. These items are sold in containers that conveniently store the items, yet once removed from the container, the consumer may want to store the item between uses. Many of the containers in which the items are sold are not convenient for such storage. The containers may be bulky or simply not strong enough for such consumer storage.

Some consumers simply wind the items and store them in a box. As is well know to anyone who has tried to use items, such as Christmas lights, after such storage, these items seem to always be tangled no matter how carefully they are stored. Such tangling is not only onerous for initial deployment of the items, it may even create a possibility of damaging the items during storage or deployment.

For this reason, the art includes several proposals for storing items such as Christmas lights. While somewhat successful in preventing tangling, most of these proposals include storage means that are cumbersome and difficult to control during both storage and deployment of the items. This is especially troublesome to the elderly, and especially if the items are being placed in difficult-to-reach places, such as on top of a house.

Still further, many of the presently-available storage means do not facilitate testing of the items stored before they are deployed. That is, for example, in the case of Christmas lights, the lights must be strung out and then tested, and then, installed after the testing is completed.

Still further, since many industries, such as the Christmas light industry, are quite competitive, any elements included in the Christmas lights should be as economical as possible. Some of the prior art storage containers used for Christmas lights are difficult to produce and may be expensive thereby inhibiting the commercial acceptance thereof.

Therefore, there is a need for a means for storing items such as Christmas lights that is convenient to use and is easy to store, yet facilitates the testing of the lights prior to deploying them from the storage means while still being economical to produce.

For the sake of convenience, this disclosure will be directed to Christmas lights; however, it is understood that the storage means disclosed herein can be used in conjunction with any long, flexible items similar to such Christmas lights, and no limitation is intended by the reference to Christmas lights.

OBJECTS OF THE INVENTION

It is a main object of the present invention to provide a means for storing long, flexible items such as Christmas lights, that is easily manageable during storing of the item and during deployment of the item.

It is another object of the present invention to provide a means for storing long, flexible items that is easy to store.

It is another object of the present invention to provide a means for storing Christmas lights.

It is another object of the present invention to provide a means for storing Christmas lights that is well balanced.

It is another object of the present invention to provide a means for storing Christmas lights which makes it easy to test the lights before deploying them.

It is another object of the present invention to provide a means for storing long, flexible items that is economical to produce.

SUMMARY OF THE INVENTION

These, and other, objects are achieved by a means for storing Christmas lights that includes a base having handle means mounted on both ends of a central axis whereby both ends of the base can be supported during storing and deployment of the lights. The base further includes means for releasably attaching the wall-plug to the base so the plug can be removed for testing while the lights are still on the base. This means is located close to the central axis in a manner to further balance the carrier.

The handle means permits the base to be rotated about the central axis so one end of the lights can be fixed while the rest of the lights are being deployed. Thus, for example, one person can hold one end of the lights while another person walks away while holding the storage means by the handles. The storage means rotates to deploy the lights. The lights can be easily tested by simply removing the plug from the device, and connecting it to a source of electricity. The light bulbs are stored in a manner that makes them easily accessible so bulbs can be tested and replaced while the lights are still on the storage means. This obviates the need to string the lights out to test them.

One form of the device includes a handle fixed to each end of a base on the central axis of the so the center of gravity of the device is on the central axis and the base can freely rotate about that central axis. Another form of the device includes swivel means connecting the handle means to the base. The handle means also includes means for pendently attaching the device to a wall or other such support for storage between uses.

The device further includes arms on opposite sides of the base with the arms being spaced apart along the central axis of the base. The arms include concave shoulders at the proximal ends thereof, and have curved edges on the distal ends thereof. The Christmas lights are wound around the base and are located between the arms.

In this manner, the storage means of the present invention is well balanced and easy to use yet is still economical to produce.

BRIEF DESCRIPTION OF THE DRAWING FIGURES

DETAILED DESCRIPTION OF THE PREFERRED EMBODIMENT OF THE INVENTION

Figure 1:
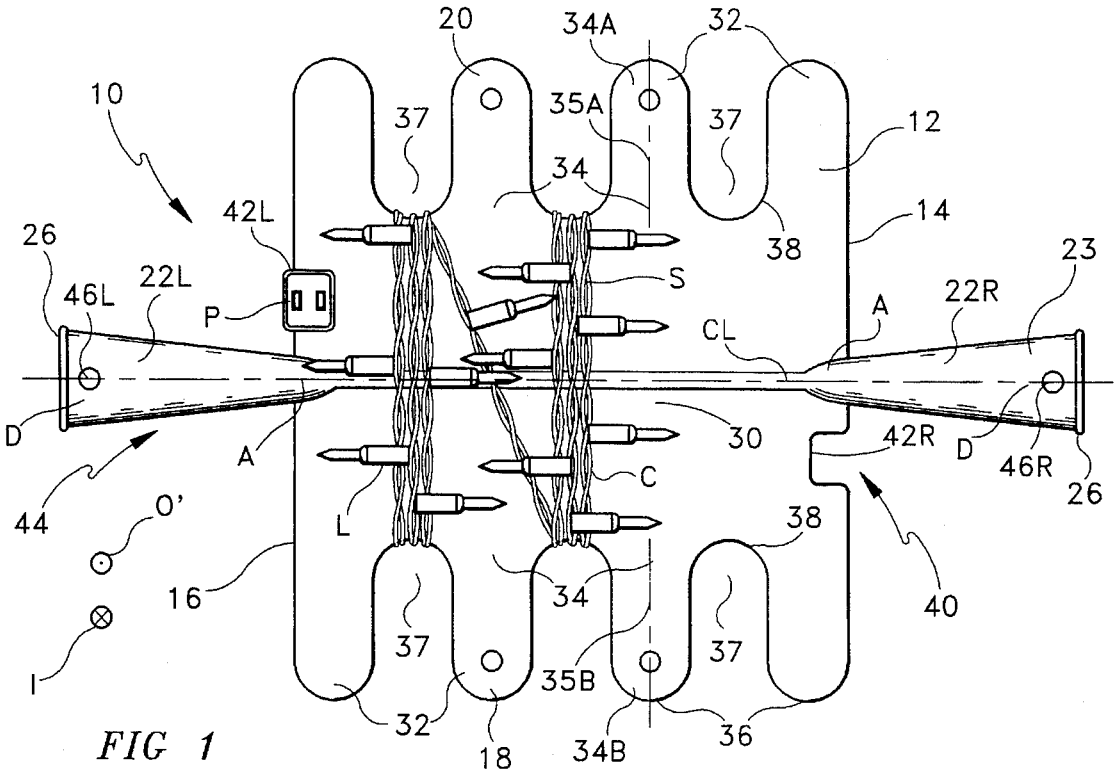
FIG. 1 is a top plan view of a fixed handle embodiment of the storage means of the present invention.

Shown in FIG. 1 is a storage means 10 for storing items, such as a string S of Christmas lights. String S include a long, flexible cord C having a multiplicity of lights L electrically attached thereto and at least one plug P for electrically attaching the string to a source of electricity such as a wall outlet, or the like. As was discussed above, string S may become tangled during storage and means 10 permits easy storage of string S in a manner that not only permits easy, non-tangle storage but also permits easy deployment and easy testing of the lights and the electrical continuity of the string. Means 10 is also easily and inexpensively manufactured so it will not unduly add to the expense of any string being stored thereon.

Specifically, means 10 includes a one-piece base 12 having ends 14 and 16 and sides 18 and 20 and a central axis CL extending from end 14 to end 16 and being located between sides 18 and 20. As will be understood from the present disclosure, means 10 rotates about central axis CL into and out of the plane of the paper, as indicated by arrows I and O or I' and O' to wind string S onto the device and/or to deploy string S from base 12.

Means 10 further includes handle means 22 on base 12 for supporting the means. Handle means 22 includes a first handle 22R mounted on the base at end 14 and second handle 22L mounted on the base at end 16. Handles 22L and 22R are fixed to base 12 in means 10 and central axis CL extends along the centerline of each handle whereby the handles are coaxial with centerline CL. A user grasping the handles will balance means 10 on centerline CL. This permits easy rotation of means 10 about centerline CL whereby a user can simply hold handle means 22 and deploy or store string S by operating on string S while holding plug P stationary. Handle means 22 can be formed of plastic material or other material that will be comfortable to the user when means 10 is rotating in his or her hands. Handles 22L and 22R include a conical section 23 with an apex A attached to the base and a flange 26 on a distal end D of each handle. The flange prevents the handles from slipping out of a user's hands while the conical shape facilitates rotation of the means.

Base 12 further includes a central section 30 and a plurality of arms, such as arm 32, having a proximal end 34 at the central section and a distal end 36 spaced from the central section. Arms 32 are spaced apart from each other along central axis CL to define gaps, such as gap 37, therebetween. String S is located in gaps 37, and concave shoulders, such as shoulder 38, are defined between adjacent arms. The arms further include curved distal ends whereby string S will not become entangled or damaged by either the arms or the base when the string is being stored or deployed. The arms are colinear with each other, that is, for example, arms 34A and 34B each have center lines, 35A and 35B, that are colinear with each other whereby the base is balanced about the central axis so it will be balanced in use.

As can be seen in FIG. 1, means 10 further includes plug accommodating means 40 for releasably attaching electrical plug P to the base. Plug accommodating means 40 includes a first cutout 42R defined in central section 30 adjacent to end 14 and second cutout 42L defined in central section 30 adjacent to end 16. Central axis CL extends between cutouts 42R and 42L so they are located on opposite sides of the central axis. The cutouts are located closely adjacent to the handles as well so the main weight of a device having a string stored thereon is as close to the central axis as possible. This weight distribution serves to ensure proper balance of the means during storage and deployment of string S.

Means 10 further includes supporting means 44 for pendently supporting means 10 during storage. Means 44 includes bores 46L and 44R in handles 22L and 22R respectively. Bores 46L and 46R are located on central axis CL so means 10 will be balanced during storage.

Figure 2:
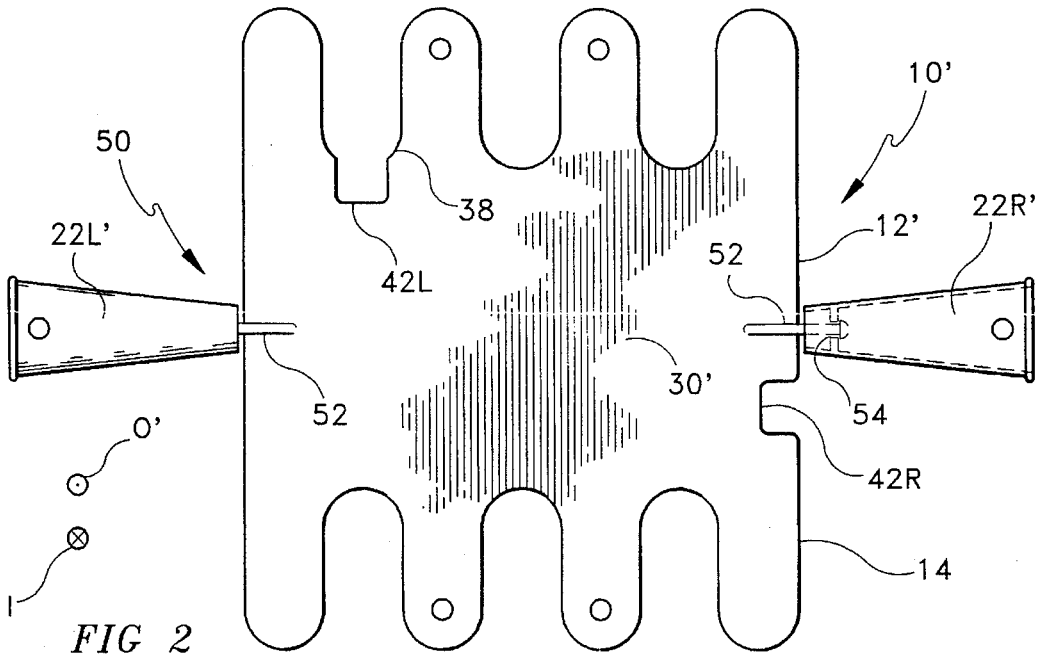
FIG. 2 is a top plan view of a swivel handle embodiment of the storage means.

A second embodiment of the storage means is shown in FIG. 2 as means 10'. Means 10' is similar to means 10 except handle means 22' is attached to base 12' by a swivel means 50 to permit base 12' to swivel with respect to handles 22L' and/or 22R' during rotation I,I' and O, O'. One form of swivel means 50 includes a pin 52 fixed to central section 30' adjacent to end and pin receiving bore 54 defined in handle 22R' to extend along the central axis of that handle. Pin 52 is positioned to extend along the central axis CL' of means 10' and extends beyond end 14' so the handles are located and pivotally mounted to the base along central axis CL'. Means 10' also includes a plug accommodating cutout 42R' defined in central section 30' adjacent to central axis CL' and plug accommodating cutout 42L' defined in central section 30' adjacent to one of the concave shoulders 38'. Cutout 42L' will be covered by string S during storage to further anchor the string during storage and during deployment. Cutout 42L' is still located closely adjacent to central axis CL' with that central axis being positioned between cutouts 42L' and 42R' for the purposes discussed above.

Figure 3:
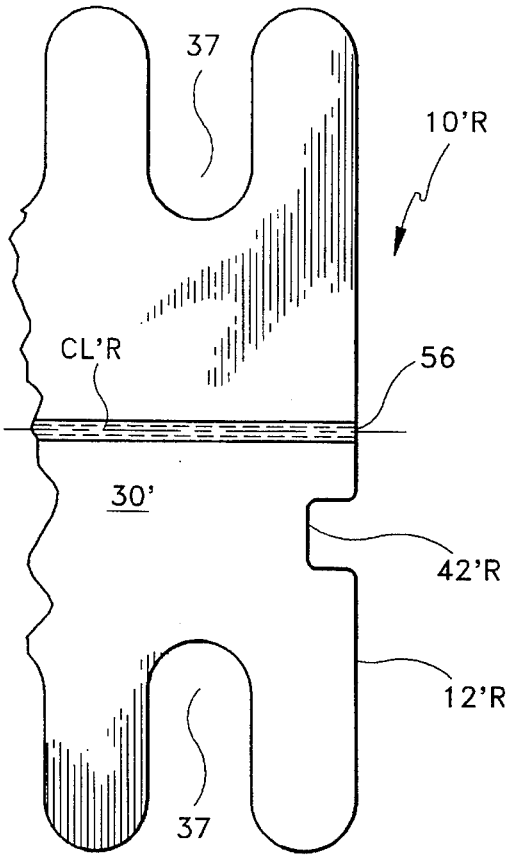
FIG. 3 is a top plan view of an end of one form of the swivel handle embodiment.
Figure 5:
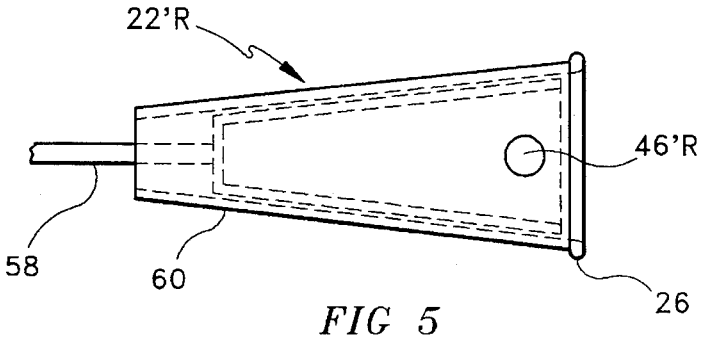
FIG. 5 is a side elevational view of one form of a handle.
Figure 6:
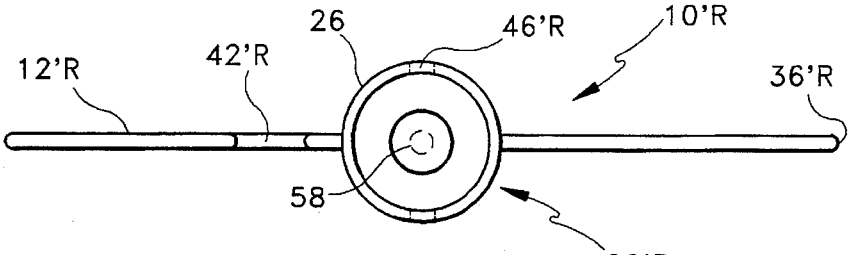
FIG. 6 is an end elevational view of a swivel handle embodiment with the FIG. 5 handle attached thereto.

Two other forms of storage means 10' are shown in FIGS. 3–8, and attention is directed thereto. Means 10'R is shown in FIGS. 3 and 6 and includes a bore 56 extending completely through central section 30' along central axis CL'. Handle means 22'R includes a rod 58 attaching each handle 22'R and 22'L together. Rod 58 extends through bore 56 and is rotatably received therein whereby base 12'R can rotate with respect to the handles. A cover 60 can be included if desired. For the sake of clarity, similar elements in means 10'R and means 10 and 10' are indicated with superscript "'" and indicator "R".

Figure 4:
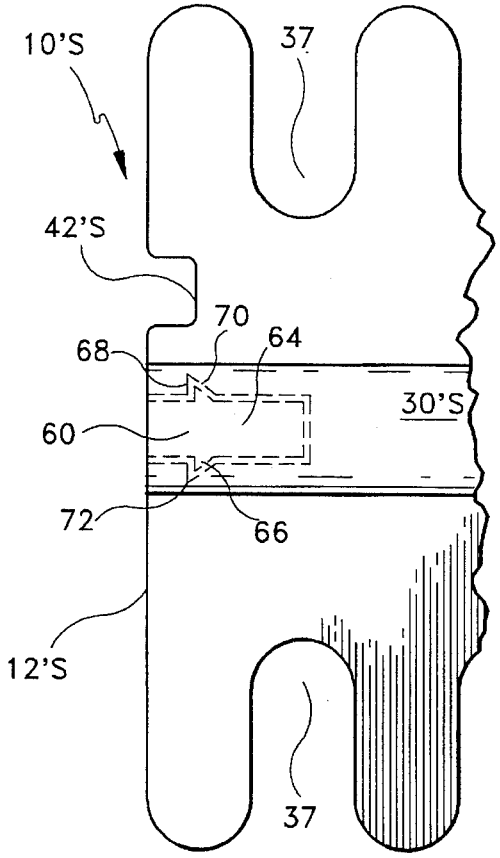
FIG. 4 is a top plan view of an end of a second form of the swivel handle embodiment.
Figure 7:
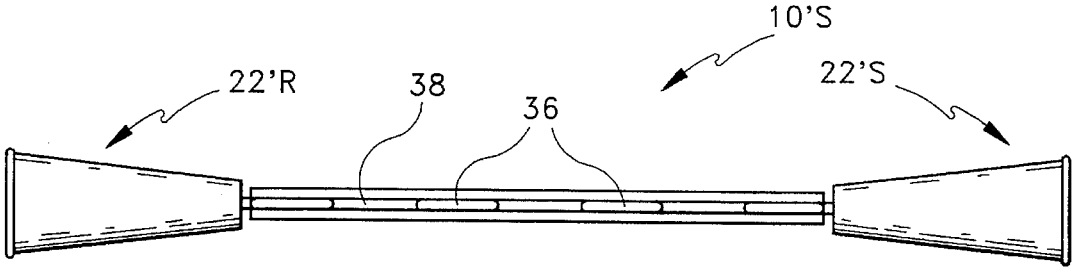
FIG. 7 is a side elevational view of a fixed handle embodiment with handles attached.

Means 10'S is shown in FIGS. 4 and 7 and is similar to means 10' except that swivel means 50 includes a cavity 60 defined in central section 30'S to extend along central axis CL'S and which rotatably receives proximal end 62 of handle 22'S. Cavity 60 includes a first cylindrical bore 64 extending along central axis CL'S and a second cavity 66 that intersects first cavity 64. Second cavity 66 includes a planar shoulder 68 that extends parallel to end 16'S, and a sloping shoulder 70 that extends from distal end 72 of shoulder 68 towards central axis CL'S and towards opposite end 14'S.

Figure 8:
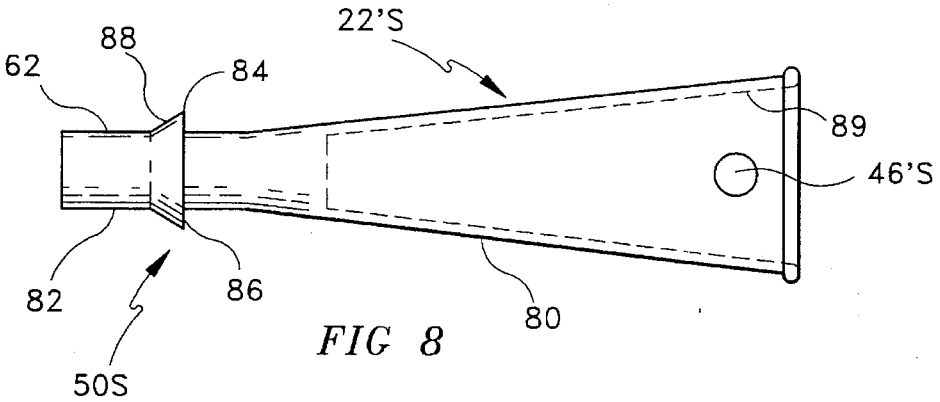
FIG. 8 is a side elevational view of a second form of handle.
Figure 9:
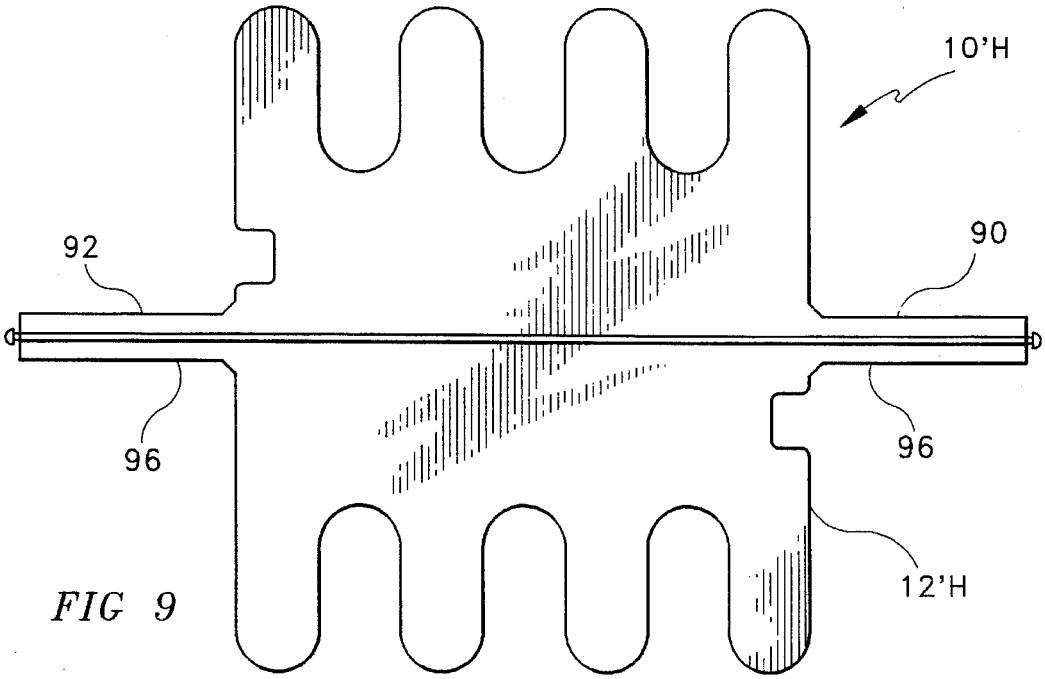
FIG. 9 is a top plan view of another form of the swivel handle embodiment.
Figure 10:
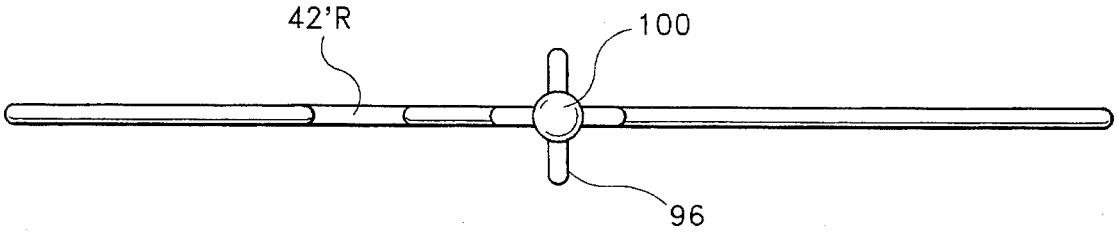
FIG. 10 is an end elevational view of the storage means shown in FIG. 9.

Handle 22'S includes a conical distal end section 80 and a cylindrical shaped proximal section 82 adjacent to end 62. A second portion 84 includes a planar shoulder 86 that extends parallel to shoulder 68 when handle 22'S is attached to base 12'S to abut shoulder 68, and a sloped shoulder 88 that is sloped to abut sloping shoulder 70 when the handle is attached to the base. The sloping shoulders slide over each other, and the planar shoulder engage to lock the handle to the base, but to permit the base to rotate with respect to the base. The cavity 60 and the projection 84 combine to form a one-way catch 50S. As shown in FIG. 8, each handle can be lined such as indicated at 89 to add support or weight to the handle.

Figure 11:
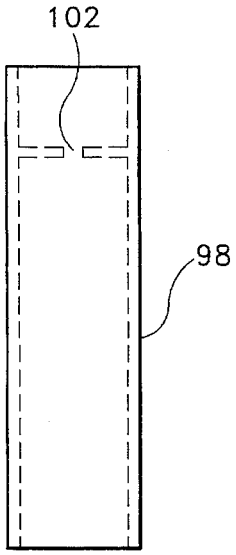
FIG. 11 is a top plan view of a handle cover used in the FIG. 9 form of the storage means.
Figure 12:
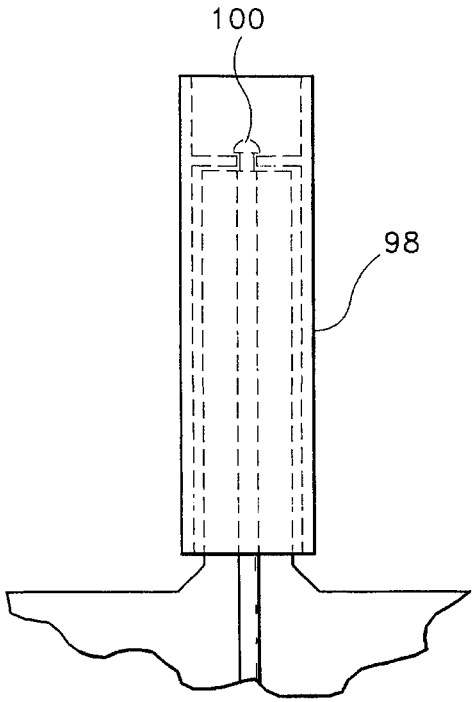
FIG. 12 is a top plan view showing the handle cover from FIG. 11 in place on a handle of the FIG. 9 form.

Yet another form of the swivel embodiment is shown in FIGS. 9–12 as means 10'H. Means 10'H is one-piece and includes two handle posts 90 and 92 which extend from respective ends of the base 12'H along the central axis of that base. Each post has a spider support 96 thereon which extends radially outwardly from the post. As shown in FIGS. 11 and 12, a hollow cover 98 is attached to each post by a cap screw 100 threaded into a distal end of the post and engaging end 102 of the cover. A washer can be interposed between the cap screw and the cover end if suitable. The cover can rotate with respect to the post if suitable whereby the base can easily rotate to wind string onto or off of the means 10'H.

It is understood that while certain forms of the present invention have been illustrated and described herein, it is not to be limited to the specific forms or arrangements of parts described and shown.

I claim:

1. A carrier for carrying long strings of items comprising:

a) a one-piece base which includes (1) two ends, two sides and a central axis extending from one end of said two ends to a second end or said two ends between said sides, (2) a central section extending from said one end to said second end, and (3) a plurality of arms each having a proximal end spaced from said central axis and a distal end spaced outward from said proximal end said arms being spaced apart from each other along said central axis in order to receive loops of stringed items therebetween;

b) handle means on said base for supporting said base from both of said ends for rotation about said central axis; and, c) plug accommodating means on said base for releasably attaching an electric wall outlet plug to said base.

2. The carrier defined in claim 1 wherein said handle means includes a first handle on said one end and a second handle on said second end.

3. The carrier defined in claim 2 wherein said handle means includes swivel means for rotatably connecting said handle means to said base.

4. The carrier defined in claim 3 wherein said swivel means includes an axle rod extending through said body along said central axis.

5. The carrier defined in claim 3 further including a one-way catch means for rotatably attaching said handle means to said base, said one-way catch means including one portion in said base and a second portion on each of said first and second handles.

6. The carrier defined in claim 3 wherein said swivel means includes a support on each of said first handle and said second handle and a cover mounted on each support.

7. The carrier defined in claim 2 wherein said plug accommodating means includes a first plug accommodating cavity defined in said body adjacent to said handle means.

8. The carrier defined in claim 7 wherein said plug accommodating means includes a second plug accommodating cavity defined in said body adjacent to said handle means, said central axis being located between said first and second plug accommodating cavities.

9. The carrier defined in claim 1 wherein said handle means includes a conical hand-grip section.

10. The carrier defined in claim 1 further including supporting means on said handle means for pendently supporting said base.

11. The carrier defined in claim 5 wherein said one portion includes a first cavity defined in said base and a second cavity defined in said base to intersect said first cavity, and said second portion includes a projection that is received in said second cavity when said handle means is connected to said base.

12. The carrier defined in claim 11 wherein said second cavity means includes a catch shoulder extending parallel to said one end and a sloped shoulder extending from one end of said catch shoulder towards said central axis and towards said second end.

13. The carrier defined in claim 1 further including a concave shoulder between adjacent arms.

14. The carrier defined in claim 6 further including a fastening means for releasably attaching each cover to an associated support.

15. The carrier defined in claim 1 wherein said handle means is one-piece with said base.

16. The carrier defined in claim 13 wherein said arm distal ends include rounded corners.

17. The carrier defined in claim 12 wherein said projection includes a catch end that abuts said catch shoulder when said handle means is connected to said base and a sloped surface that slopes from one end of said catch end towards said central axis and abuts said sloped shoulder when said handle means is connected to said base.

18. The carrier defined in claim 1 wherein said handle means includes a flange on said distal end thereof.

19. The carrier defined in claim 1 wherein said plug accommodating means is located closely adjacent to said central axis.

20. The carrier defined in claim 10 wherein said supporting means is located on said central axis.

21. A light string organizer, storage and dispenser device comprising:

a) a planar base defined about a central axis by spaced-apart ends;

b) said base further defined by a plurality of arms extending in opposite directions transverse to said central axis between said base ends, each said arm including a distal end and a proximal end in spaced-apart relationship;

c) said distal ends of said arms defining opposed side edges of said device;

d) wherein said arms are spaced from each other a distance sufficient to form a gap therebetween to accept therein a plurality of loops of stringed lights thereabout; and, e) further including handle means extending axially from each said end for grasping during use to allow said device to twist about said central axis as the strings are wrapped about or deployed from said base.

22. The carrier defined in claim 21 wherein said handle means includes a first handle on said one end and a second handle on said second end.

23. The carrier defined in claim 22 wherein said handle means includes swivel means for rotatably connecting said handle means to said base.

24. The carrier defined in claim 23 wherein said swivel means includes an axle rod extending through said body along said central axis.

* * * * *